US005096540A

United States Patent [19]

Sell et al.

[11] Patent Number: 5,096,540

[45] Date of Patent: Mar. 17, 1992

[54] METHOD FOR RECYCLING SULFUR DIOXIDE FROM SULFITE PULPING LIQUORS

[76] Inventors: Nancy J. Sell, 3244 Peterson Rd.; Jack C. Norman, 2796 N. Nicolet, both of, Green Gay, Wis. 54311

[21] Appl. No.: 505,422

[22] Filed: Apr. 6, 1990

[51] Int. Cl.[5] ..... D21C 11/00

[52] U.S. Cl. ..... 162/16; 162/36; 162/45

[58] Field of Search ..... 162/16, 36, 42, 45

[56] References Cited

U.S. PATENT DOCUMENTS

| | | | |
|---|---|---|---|
| 3,822,180 | 7/1974 | Mita et al. | 162/36 |
| 4,148,684 | 4/1979 | Farin | 162/36 |
| 4,187,279 | 2/1980 | Rimpi | 422/185 |
| 4,336,102 | 6/1982 | Jacobs et al. | 162/36 |
| 4,336,189 | 6/1982 | Hamala et al. | 530/305 |

OTHER PUBLICATIONS

Research Needs in the Pulp and Paper and Related Industries, The University of Maine, Jul. 12-13, 1988, pp. ix and xvi.

*Primary Examiner*—Karen M. Hastings
*Assistant Examiner*—Charles K. Friedman
*Attorney, Agent, or Firm*—Reising, Ethington, Barnard, Perry & Milton

[57] ABSTRACT

Combined acidification and evaporative concentration of sulfite based chemical and sulfite based semichemical spent liquors expel massive amounts of gaseous sulfur dioxide and water vapor from the spent liquor.

The concentration of the expelled sulfur dioxide is sufficiently high so that the sulfur dioxide and water vapor can be recycled directly, without further separation, to produce fresh sulfite pulping liquor.

3 Claims, 10 Drawing Sheets

ACIDIFICATION AND EVAPORATIVE CONCENTRATION PROCESS

ACIDIFICATION AND EVAPORATIVE CONCENTRATION
78% YIELD SODIUM BISULFITE SPENT LIQUOR

DISTRIBUTION OF SULFUR SPECIES AS MG SULFUR/100 ML SPENT LIQUOR

| | TOTAL SULFUR | SULFATE | FREE SULFITE | LOOSELY BOUND SULFITE | SULFONE BY DIFFERENCE | SULFUR DIOXIDE EXPELLED |
|---|---|---|---|---|---|---|
| 100 ML SPENT LIQUOR PLUS 24 MMOL H+ | 987 | 63 | 58 | 7 | 859 | |
| EVAPORATED TO 50 ML | 353 | 60 | 3 | 8 | 322 | 621 (63%) |
| EVAPORATED TO NEAR DRYNESS | | | | | | 636 (64%) |

Fig-2

ACIDIFICATION AND EVAPORATIVE CONCENTRATION
42% YIELD CALCIUM SULFITE SPENT LIQUOR

DISTRIBUTION OF SULFUR SPECIES AS MG SULFUR/100 ML SPENT LIQUOR

| | SULFUR DIOXIDE EXPELLED | TOTAL SULFUR | SULFATE | FREE SULFITE | LOOSELY BOUND SULFITE | SULFONE BY DIFFERENCE |
|---|---|---|---|---|---|---|
| 100 ML SPENT LIQUOR PLUS 24 MMOL H+ | | 900 | 55 | 2 | 13 | 830 |
| EVAPORATED TO 50 ML | 172 (19%) | 728 | 60 | 1 | 3 | 623 |

Fig-6

ACIDIFICATION AND EVAPORATIVE CONCENTRATION
83% YIELD NSSC SPENT LIQUOR

DISTRIBUTION OF SULFUR SPECIES AS MG SULFUR/100 ML SPENT LIQUOR

■ NO ACID
● 12 MOL/L HYDROCHLORIC ACID
✱ 18 MOL/L SULFURIC ACID

ACIDIFICATION AND EVAPORATIVE CONCENTRATION
49% YIELD CALCIUM SULFITE SPENT LIQUOR

DISTRIBUTION OF SULFUR SPECIES AS MG SULFUR/100 ML SPENT LIQUOR

| | | TOTAL SULFUR | SULFATE | FREE SULFITE | LOOSELY BOUND SULFITE | SULFONE BY DIFFERENCE |
|---|---|---|---|---|---|---|
| | 100 ML SPENT LIQUOR PLUS 24 MMOL H+ | 871 | 71 | 1 | 23 | 775 |
| 262 (30%) | EVAPORATED TO 50 ML | 589 | 83 | 1 | 0 | 502 |

SULFUR DIOXIDE EXPELLED

Fig-10

METHOD FOR RECYCLING SULFUR DIOXIDE FROM SULFITE PULPING LIQUORS

BACKGROUND OF THE INVENTION

1. Field of Invention

This invention relates to a chemical recovery process for recovering sulfur from spent pulping liquors and, more specifically, relates to recovery of sulfur dioxide from sodium sulfite, calcium sulfite, magnesium sulfite, and ammonium sulfite semichemical and chemical spent pulping liquors.

2. Description of the Related Art

For most sulfite pulping processes, a simple and economical chemical recovery system, to recycle the sulfur based chemicals, has not been developed. Spent sulfite pulping liquors are often sewered to secondary waste treatment or are burned without chemical recycling. The use of a recycling process reduces the amount of fresh sulfur dioxide raw material which must be used for the pulping, and recycling minimizes the amount of waste which must be further processed.

This invention is a recovery process for recycling sulfur dioxide from the spent liquor from sulfite chemical or sulfite semichemical processes.

Papermaking pulp is manufactured by (1) mechanical, (2) chemical, and (3) semichemical processes.

Mechanical pulping processes, (1), produce pulp by using mechanical energy to shred and separate raw material fibers.

In chemical pulping processes, (2), wood chips are cooked with chemicals in an aqueous solution at elevated temperature and pressure. Wood is comprised primarily of cellulose, lignin, and hemicelluloses. The pulping chemicals solubilize the lignin, which holds together the fibers in the wood.

The two major chemical pulping processes are the kraft process and the sulfite process. The invention is an improvement to the sulfite process.

The sulfite process uses a combination of sulfurous acid, sulfite ion, and bisulfite ion to solubilize the lignin. The chemicals used for the sulfite process are sulfites and bisulfites of calcium, magnesium, sodium, or ammonium; sulfite pulping can be carried out over a wide range of pH.

Semichemical pulping processes, (3), combine chemical and mechanical methods. Wood chips are partially softened with chemicals; the balance of the pulping is by mechanical force.

Mechanical pulping processes convert 90% to 95% of the wood into pulp.

In chemical processes, much of the lignin, the hemicelluloses, and some of the cellulose is solubilized by the chemicals. The pulp yield, based on original dry wood weight, is 40% to 55%.

The pulp yields from sulfite semichemical methods range between mechanical pulping yields and chemical pulping yields. That is, the yields range from 55% to 90%.

In each process, a portion of the original dry wood is solubilized and forms part of the spent liquor. Lignosulfonates, the reaction products of the lignin and the sulfite pulping chemicals, are produced.

Sulfite recovery systems have been developed for both semichemical and chemical pulping processes. Examples are U.S. Pat. Nos. 1,892,100, 1,973,557, 1,659,193, 2,022,872, 2,496,550, 2,642,336, 2,730,445, 2,701,763, 4,148,684, 4,241,041, 4,212,702, and 4,336,189.

None of the existing processes is similar to that of the petitioners. The petitioners' process is simpler and more economical. As can be seen from the following description of the related art, all of the competing recovery systems require a recovery furnace. Petitioner's does not.

Current Sulfite Recovery Related Art

Calcium Sulfite Based Liquors

Recycling of calcium-base spent liquors is not practiced. Reduction of calcium sulfate to calcium oxide and sulfur dioxide by existing methods can be accomplished only at temperatures higher than those attained in a conventional spent liquor burning operation. Spent calcium sulfite liquor can be burned for heat recovery.

Magnesium Sulfite Based Liquors

To recycle magnesium-base sulfite pulping chemicals, the spent liquor is concentrated from about 9% solids to 55% or 60% solids; the liquor then is sprayed into a recovery furnace and burned without additional fuel. The steam generated, which contains sulfur dioxide and magnesium oxide, is recovered for use in pulp cooking.

An alternative system for decomposing the spent magnesium bisulfite cooking liquor to magnesium oxide and sulfur dioxide is by burning the spent liquor in a fluidized bed process. The liquor can be combusted without additional fuel to form a magnesium oxide ash. The ash remains in the reactor and becomes incorporated into the bed. Sulfur dioxide is given off at the same time and the sulfur dioxide is removed with the flue gas.

Ammonium Sulfite Based Liquors

Existing ammonia-base sulfite pulping systems recover sulfur only; the ammonia is converted to nitrogen and water. No recovery of ammonia is possible from conventional burning operations.

The spent liquor from ammonia-based sulfite pulping systems is concentrated to 50% solids and is then burned either as a secondary fuel in a steam generation boiler, or without supplementary fuel if preheated air is utilized. The sulfur dioxide generated in the burning can be absorbed in water to which fresh ammonia is added.

A fluidized bed combustion process similar to that used for a magnesium sulfite process can also be used for the ammonia-base liquors. No ash is formed. The sulfur dioxide given off can be recovered from the flue gas.

Sodium Sulfite Based Liquors

The majority of the recycling processes for sodium-base sulfite pulping processes are based on the concentration and subsequent combustion of the spent liquor in kraft type recovery furnaces.

Other sodium sulfite recovery methods pyrolyze the spent sodium sulfite liquors. The sulfur is emitted from the pyrolysis process as gaseous hydrogen sulfide.

Another sulfur recovery process for sodium sulfite liquor is by fluidized bed combustion. Oxidative fluidized bed burning generates sodium sulfate and sodium carbonate which is suitable only for use as a kraft process makeup chemical.

New Sulfur Dioxide Recycling System

SUMMARY OF THE INVENTION

This invention is a novel process for recycling sulfur dioxide from sulfite based chemical and sulfite based semichemical spent pulping liquors. Combined acidification and evaporative concentration expels massive amounts of gaseous sulfur dioxide and water vapor from the spent liquor. The concentration of the expelled sulfur dioxide is sufficiently high so that the sulfur dioxide and water vapor can be recycled directly, without further separation, to produce fresh sulfite pulping liquor.

Acidification alone, or evaporative concentration alone, expels only small amounts of sulfur dioxide from spent sulfite pulping liquors. If the two processes are combined, however, each to the extent as determined in empirical tests of the specific spent liquor, a significant release of gaseous sulfur dioxide occurs. Greater than two-thirds of the sulfur in the spent liquor can be simply and economically recovered by the appropriate application of this new recovery process.

The sulfur dioxide which is released in this process is formed out of the free sulfur dioxide, from the loosely combined sulfur dioxide, and from the lignosulfonates in the spent sulfite liquor.

BRIEF DESCRIPTION OF THE DRAWINGS

FIG. 2 is a chart which identifies the various sulfur containing components of a first particular spent liquor, before and after treatment.

FIG. 6 is a chart that identifies the various sulfur species of the second specific liquor before and after treatment.

FIG. 10 is a chart that identifies the various sulfur species in the fourth spent liquor before and after treatment.

DETAILED DESCRIPTION OF THE INVENTION

In the sulfite pulping of wood, rags, or other fibrous raw materials, the spent pulping liquors contain sulfur which can be recovered and recycled back into the pulping liquor. There is no widely used sulfur recovery method for most of the sulfite pulping methods.

Figure 1:
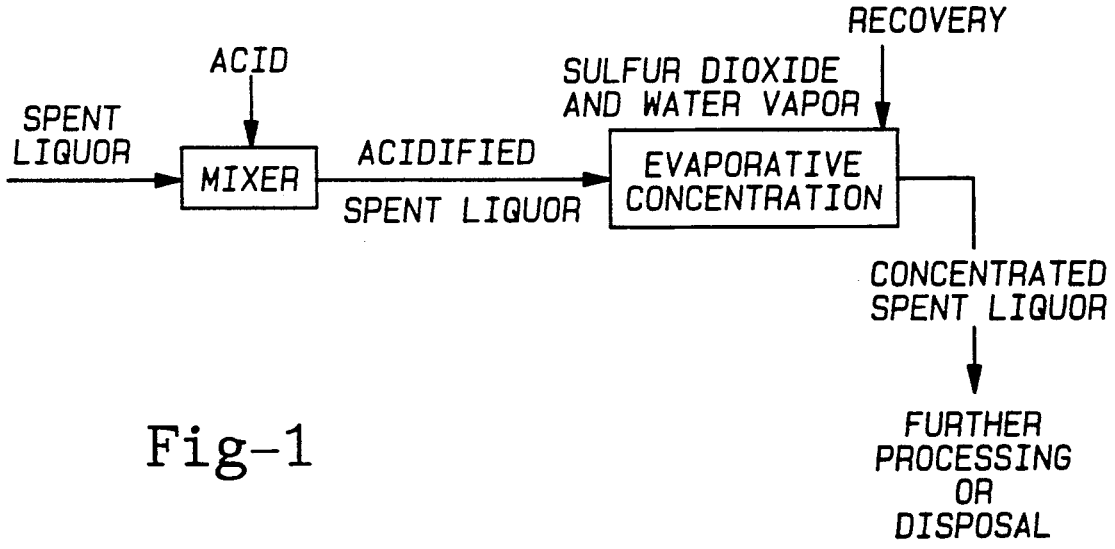
FIG. 1 is a flowsheet of this new sulfur dioxide recycling process.

In this invention, a combination of acidification and evaporative concentration expels sulfur dioxide gas from the spent liquor. FIG. 1 is a flowsheet which summarizes this new sulfur dioxide recovery process.

An appropriate amount of acid is mixed with spent sulfite liquor. This acidified mixture is evaporatively concentrated a predetermined amount, at or near the boiling point of the mixture. The emitted gaseous sulfur dioxide and water vapor is collected and can be recycled to regenerate sulfite pulping liquor. The remaining spent liquor can be further processed for heat recovery, chemical recovery, or can be disposed of by waste treatment methods.

Sulfite pulping is based on the reaction of sulfite and bisulfite ion with lignin in wood. The resulting organic sulfur compounds are lignosulfonates, also called sulfones.

In this new recovery process, the sulfur dioxide is produced from the free sulfur dioxide, the loosely combined sulfur dioxide, and, especially, from the sulfones present in the spent liquor.

The sources of the sulfur dioxide generated are identified in FIG. 2. In this spent liquor sample, the sulfur present in the sample as sulfones decreases from 859 mg sulfur to 322 mg sulfur upon the addition of 24 mmol of hydrogen ion and evaporation to 50% of the original volume.

Acidification alone, or evaporative concentration alone, does not expel significant amounts of sulfur dioxide. It is only in conjunction with one another that these treatments lead to the massive sulfur dioxide emission that occurs.

Figure 3:
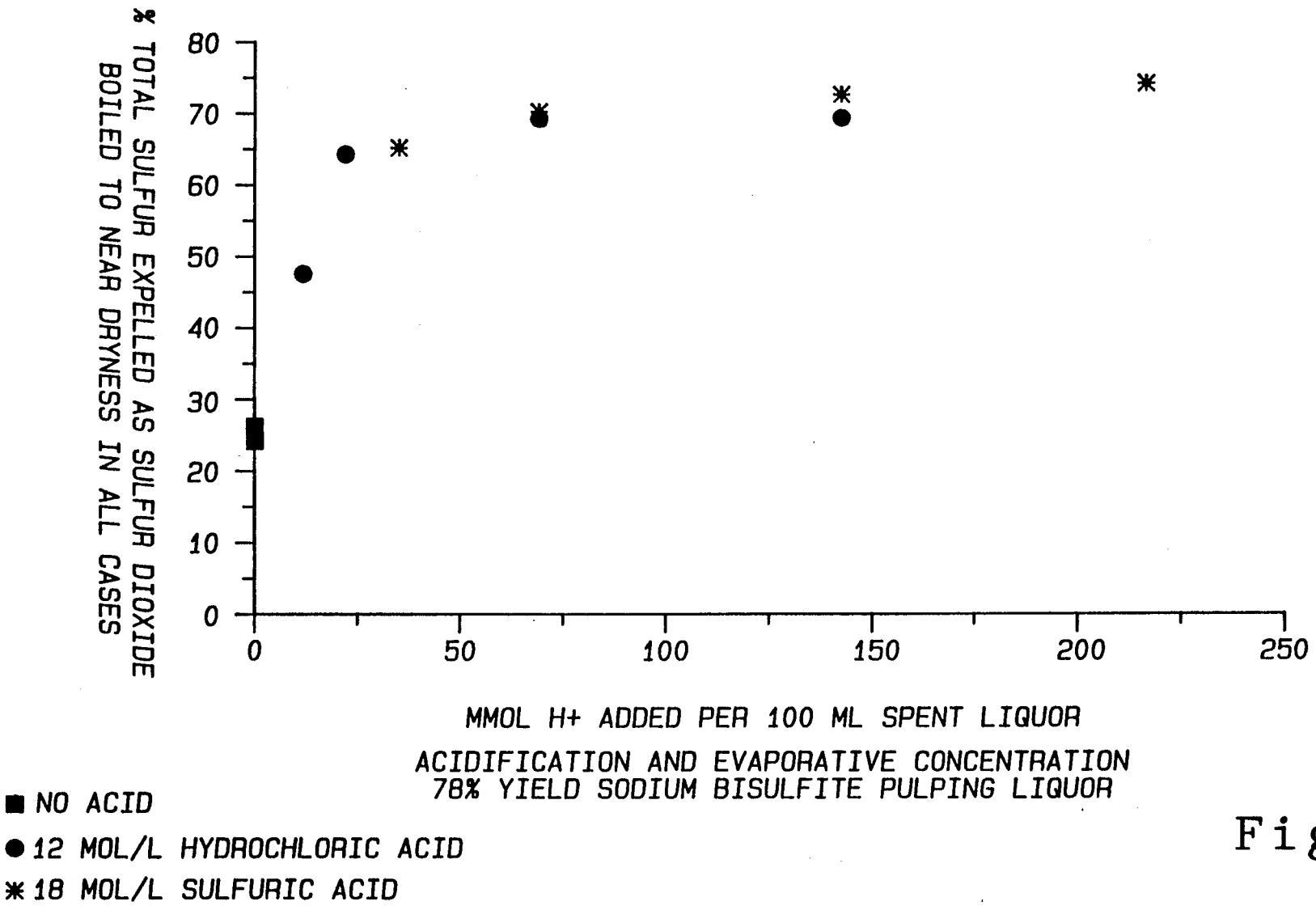
FIG. 3 is a graph that summarizes sulfur dioxide recovery from acidification and evaporative concentration of the first example bisulfite spent liquor.

FIG. 3 illustrates the effect of various amounts of acid added to a spent sulfite liquor. In all cases, the spent liquor was evaporated to dryness. Adding no acid, but evaporating to dryness, expels about 25% of the sulfur as sulfur dioxide; adding as little as 50 mmol of hydrogen ion per 100 ml of spent liquor increases the amount of sulfur dioxide expelled to almost 70%.

FIG. 3 illustrates the use of two different acids, sulfuric acid and hydrochloric acid. The results can be superimposed to produce one curve, illustrating that it is the hydrogen ion concentration which is of importance, not the nature of the associated anion.

Figure 4:
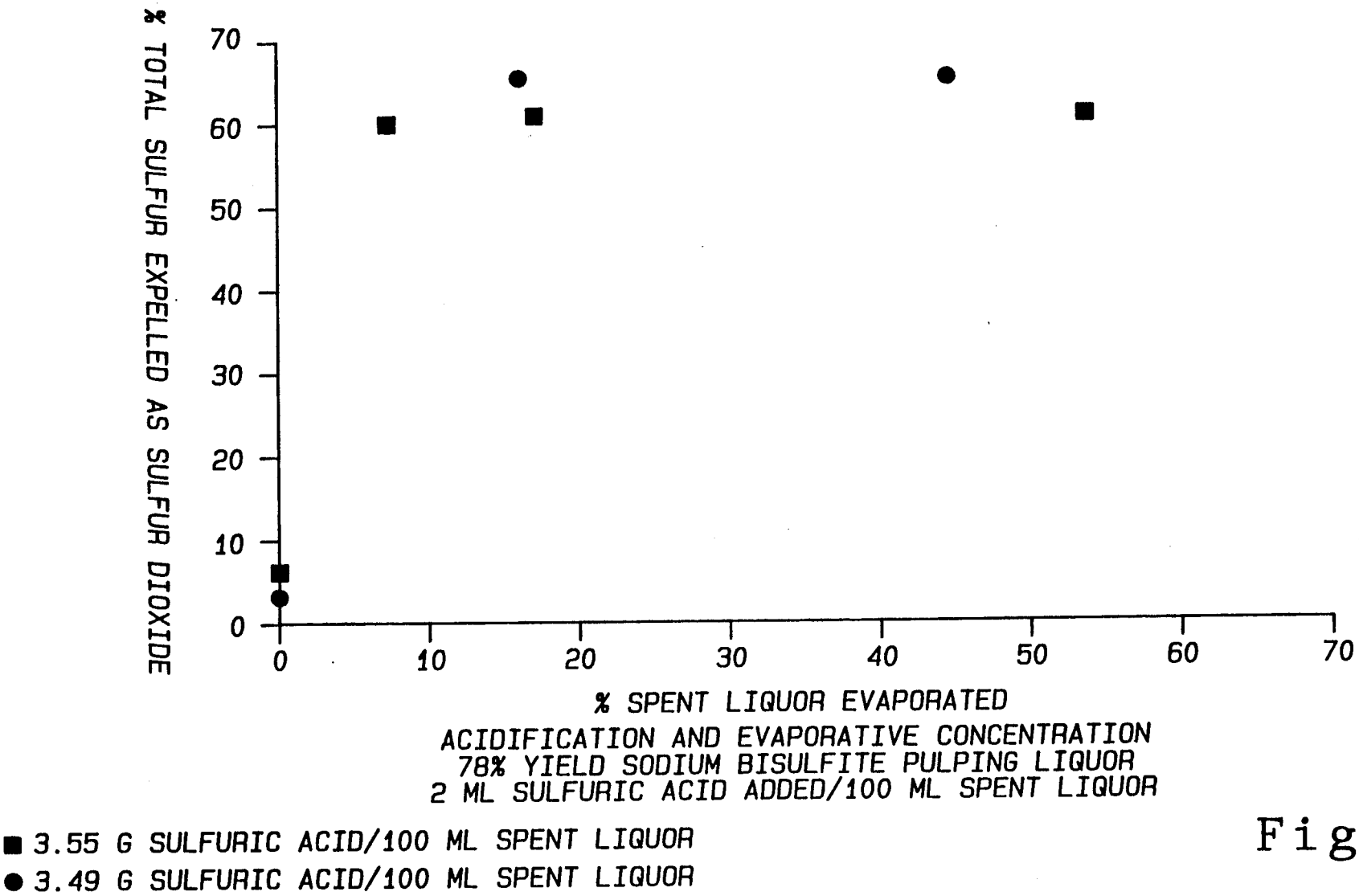
FIG. 4 is a graph of the effect of evaporation of an acidified spent liquor, the first example.

FIG. 4 illustrates the effect of various amounts of evaporative concentration at a constant acid addition level. In all cases, 50 mmol of hydrogen ion were added per 100 ml of spent liquor. Only about 5% of the sulfur was emitted as sulfur dioxide if there was no evaporative concentration. Less than 5% evaporative concentration, combined with the acid addition, increases the amount of sulfur dioxide emitted to greater than 60% of the total sulfur available.

Table 1 summarizes the amount of sulfur which can be released from different yield spent pulping liquors, from different pulping mills, and containing different ions, all of which have been treated with 72 mmol of hydrogen ion per 100 ml spent liquor and evaporatively concentrated to 50% by volume. As can be noted, in all cases the combined acidification and concentration does release sulfur dioxide, though the process is more effective in recovering sulfur dioxide from the higher yield semichemical pulping liquors.

TABLE 1

SULFUR DIOXIDE EXPELLED FROM SPENT SULFITE PULPING LIQUORS

| Pulp Yield % | Cation | Total Sulfur (mg S) per 100 mL spent liquor | Sulfur Dioxide (as mg S) Expelled from 100 mL Weak Spent Liquor When Evaporately Concentrated to 50% | |
|---|---|---|---|---|
| | | | 72 mmol hydrogen ion per 100 mL % of total S | no acid added % of total S |
| 85 | Na+ | 280 | 51 | 1 |
| 83 | Na+ | 738 | 61 | 9 |
| 78 | Na+ | 987 | 65 | 17 |
| 60 | NH4+ | 557 | 19 | 15 |
| 52 | Mg++ | 1293 | 9 | 7 |
| 49 | Ca++ | 871 | 32 | 19 |
| 42 | Ca++ | 900 | 16 | 9 |

Acidification and evaporative concentration treatment of spent sulfite liquors expels a significant amount of the sulfur from sulfite spent liquors directly as sulfur dioxide. In the sulfite based processes, the sulfur dioxide must be further converted to sulfite and bisulfite before reuse as cooking liquor. To do so, the sulfur dioxide is reacted with an aqueous solution, such as, of sodium carbonate, calcium hydroxide, magnesium hydroxide or ammonia to regenerate sulfite and bisulfite.

The gas emitted during this recovery process is a mixture of sulfur dioxide and water vapor. The relative amount of the two gases is dependent upon the amount of evaporative concentration which occurs. Assume, for example, the spent liquor is evaporated 10%, and simultaneously 67% of the available sulfur is emitted as sulfur dioxide. If the original spent liquor contains 900 mg of sulfur per 100 ml of liquor, about 600 mg of sulfur, or 1.2 g of sulfur dioxide, is contained in the gaseous mixture which also contains about 10 g of water vapor. Thus, the gas which is emitted contains 12% sulfur dioxide. A typical sulfite chemical cooking liquor, prior to fortification with the sulfur dioxide from digester relief gas, is 4.0% to 4.2% sulfur dioxide. The sulfur dioxide and water vapor mixture from this recycling system is of an appropriate concentration to be used directly as a sulfur dioxide makeup chemical. [The remaining 40% of the sulfur dioxide required could be provided by fresh chemical or by sulfur dioxide recovered by a different, additional recovery process.]

Most pulping mills concentrate their spent liquor to at least 50% solids (by weight) prior to waste treatment, burning, or further processing. Since evaporative concentration alone, without acidification, does not significantly release sulfur dioxide, see FIG. 3, the spent liquor can be concentrated prior to acidification and the resulting massive sulfur dioxide expulsion.

As noted in FIG. 4, very little additional sulfur dioxide is released after 15% or 20% evaporation. A second option is to evaporatively concentrate the liquor in two stages. The first stage is as described above; the spent liquor is acidified and evaporatively concentrated to an optimum level, which is determined by the amount of evaporative concentration needed to expel nearly all of the available sulfur dioxide and by the desired sulfur dioxide/water vapor ratio for the regeneration of the sulfite cooking liquor. A second evaporation then concentrates the spent liquor further, to a solids content appropriate for further treatment. This second stage concentration is equivalent to the existing evaporation and concentration which is currently practiced.

EMPIRICAL DETERMINATION AND BEST METHOD

In the new recovery process, spent liquor is mixed with an acid and is then heated to evaporate and concentrate the spent liquor. This combined acidification, evaporation and concentration produces sulfur dioxide. Since the solubility of all gases in any liquid is essentially zero at the boiling point of that liquid, evaporating and concentrating the spent liquor at or near the boiling point liberates all of the available sulfur dioxide as a mixture of sulfur dioxide gas and water vapor.

The sulfur dioxide and water vapor mixture which is liberated is recycled to regenerate sulfite cooking liquor by a conventional process.

The remaining spent liquor contains the sulfur compounds which were not converted to and expelled as sulfur dioxide. In the remaining aqueous liquor are also inorganic chemicals, such as carbonates, and dissolved organic compounds. This liquor can be further processed for heat or chemical recovery, or it can be disposed of by waste treatment techniques.

The acidification and evaporative concentration for sulfur dioxide recovery can be conducted in commercially available equipment. For example, the spent sulfite liquor from pulp washers can be acidified in a mixing tank. This acidified liquor would be concentrated in, for example, a multieffect evaporator. Other commercially available evaporators and concentrators can also be used, such as cascade evaporators or falling film type evaporators. The gaseous sulfur dioxide and water vapor mixture is recycled to conventional cooking liquor preparation for reuse. The remaining spent liquor can be concentrated further in additional evaporators, and then further processed for chemical recovery, heat recovery, or sent to waste treatment.

EXAMPLES

For each liquor, empirical tests will have to be made to determine the optimum acidification and concentration. The following examples illustrate how specific spent liquors respond to this recovery process.

EXAMPLE I

78% yield sodium bisulfite spent liquor.

As a first example of how much sulfur dioxide can be expelled by this treatment process, Table 2 summarizes various parameters for a 78% yield sodium bisulfite spent pulping liquor, using a hardwood furnish.

TABLE 2

| Parameters of the Spent Liquor | |
|---|---|
| pH | 5.25 |
| % Solids | 11.0% |
| Density (g/ml) | 1.05 |
| Total S (mmol/ml) | 0.424 |
| % S | 1.36% |
| Sulfite (mmol/ml) | 0.152 |
| Thiosulfite (mmol/ml) | 0.027 |
| Sulfide (mmol/ml) | 0.030 |
| Sulfate (mmol/ml) | 0.014 |
| Heating Value | |
| Btu/lb OD solids | 2700 |
| kJ/g OD solids | 6.29 |

FIG. 3 indicates, for this specific liquor of this specific yield, the amount of sulfur dioxide which is removed at various additions of acid.

Two different acids were used in this example to show that the important factor is the hydrogen ion concentration.

In this test, the acid additions varied from zero to 0.36 mmol hydrogen ion per mg total sulfur in the untreated spent liquor. As can be seen, as little as 0.025 mmol hydrogen ion added per mg of total sulfur in the untreated liquor is sufficient to expel 65% of the sulfur as sulfur dioxide when combined with evaporation of the spent liquor to near dryness. Increasing the acid addition to about 0.15 mmol hydrogen ion per mg total sulfur correspondingly increases the sulfur dioxide expulsion to greater than 70% of that available.

FIG. 4 indicates, for this specific spent liquor of a specific yield, the effect of evaporation at a constant acid addition level.

This figure illustrates that evaporating the spent liquor as little as 5%, in combination with an acid addition of 0.024 mmol hydrogen ion per mg total sulfur in the untreated liquor, is sufficient to expel 60% of the sulfur as sulfur dioxide.

FIG. 2 compares the sulfur species present in the untreated liquor and in the liquor after acidification and 50% concentration. The decrease in sulfone sulfur from 859 to 322 mg per 100 ml spent liquor illustrates that the combined acidification and evaporative concentration releases sulfur dioxide from the lignosulfonates in the spent liquor.

EXAMPLE II

42% yield calcium sulfite spent liquor.

Figure 5:
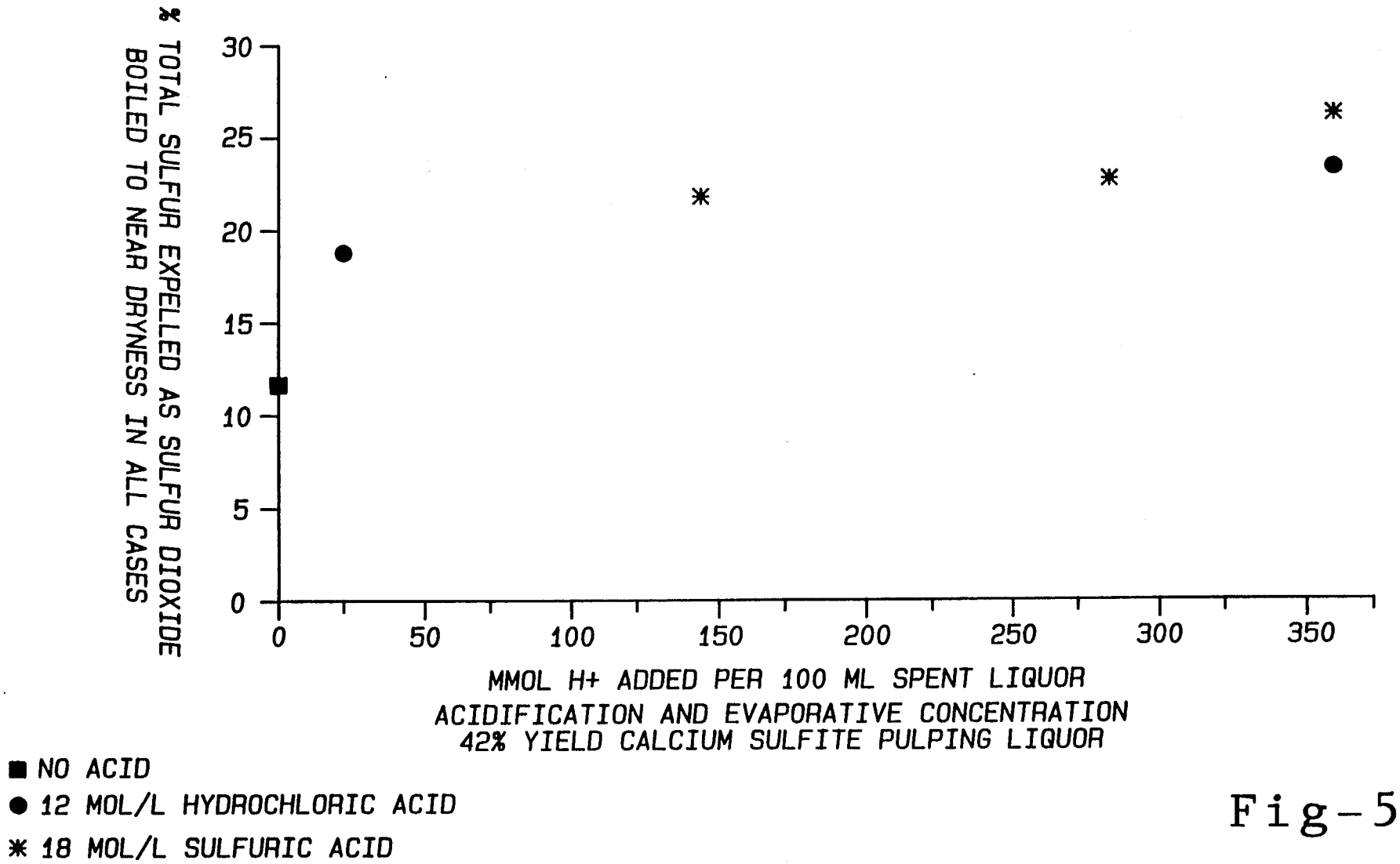
FIG. 5 is a graph that summarizes the chemical recovery results of acidification and evaporative concentration on a second specific spent liquor.

As a second example of how much sulfur dioxide can be expelled by this treatment process, FIG. 5 summarizes the amount of sulfur which can be removed from a 42% yield calcium-based sulfite chemical pulping system as a function of hydrogen ion addition. In this test, the acid addition varied from zero to 0.40 mmol hydrogen ion per mg total sulfur in the untreated spent liquor. In this example, a larger acid addition was required to reach the maximum expulsion plateau.

FIG. 6 compares the sulfur species present in the untreated liquor and in the liquor after acidification with 24 mmol hydrogen ion per 100 ml liquor and 50% concentration. Again, the decrease in sulfone concentration verifies the release of sulfur dioxide from the lignosulfonates in the spent liquor.

EXAMPLE III

85% yield NSSC spent liquor.

Figure 7:
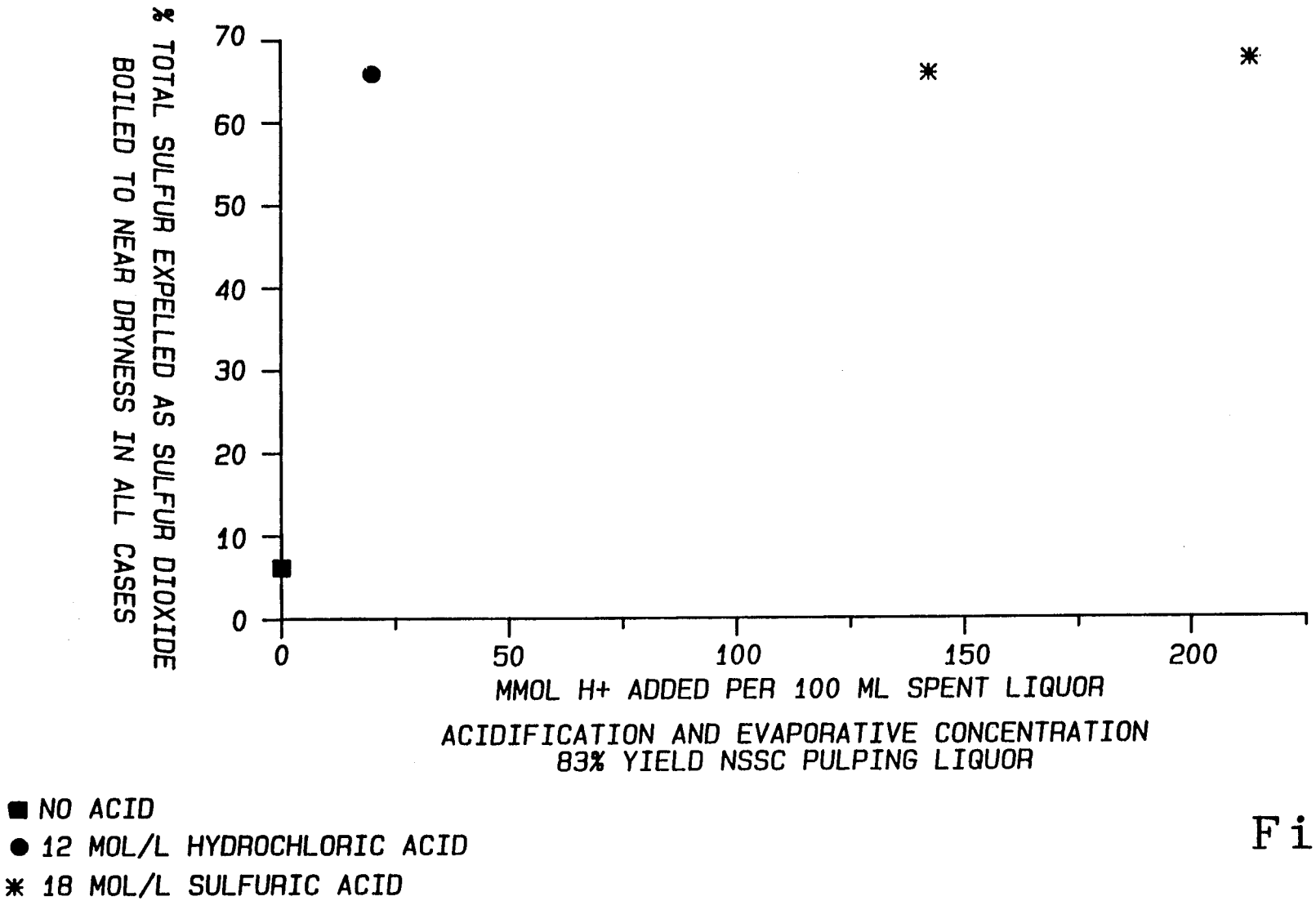
FIG. 7 is a graph that summarizes the chemical recovery results of acidification and evaporative concentration on a third specific spent liquor.

As a third example of how much sulfur dioxide can be expelled by this treatment process, FIG. 7 summarizes the amount of sulfur which can be removed from a 85% yield sodium-based neutral sulfite semichemical (NSSC) pulping system as a function of hydrogen ion addition. In this test, the acid addition varied from zero to 0.75 mmol hydrogen ion per mg total sulfur in the untreated spent liquor. Since this spent liquor is much lower in total sulfur than in the other examples (about 280 mg sulfur per 100 ml of spent liquor), the ratio of mmol hydrogen ion to mg of sulfur is much greater. Adding as little as 24 mmol hydrogen ion per 100 ml of spent liquor provides 0.085 mmol hydrogen ion per mg sulfur. This is sufficient acid addition to expel the maximum available sulfur dioxide when the liquor is simultaneously evaporated to near dryness.

Figure 8:
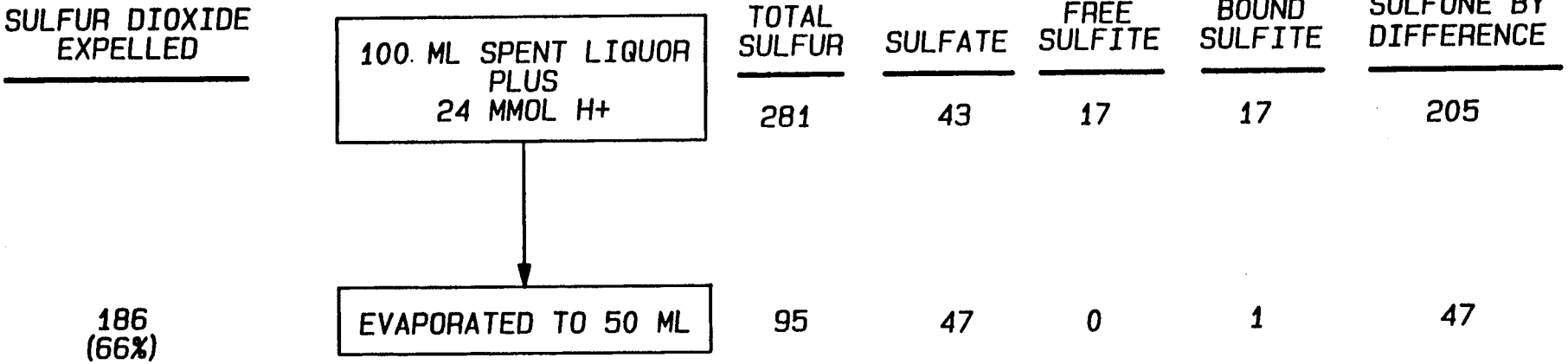
FIG. 8 is a chart that identifies the various sulfur species of the third specific spent liquor before and after treatment.

FIG. 8 compares the sulfur species present in the untreated liquor and in the liquor after acidification with 24 mmol hydrogen ion per 100 ml of liquor and 50% concentration. In this example, the sulfone concentration decreased from 205 to 47 mg of sulfur per 100 ml spent liquor during the acidification and evaporation treatment.

EXAMPLE IV

49% yield calcium sulfite spent liquor

Figure 9:
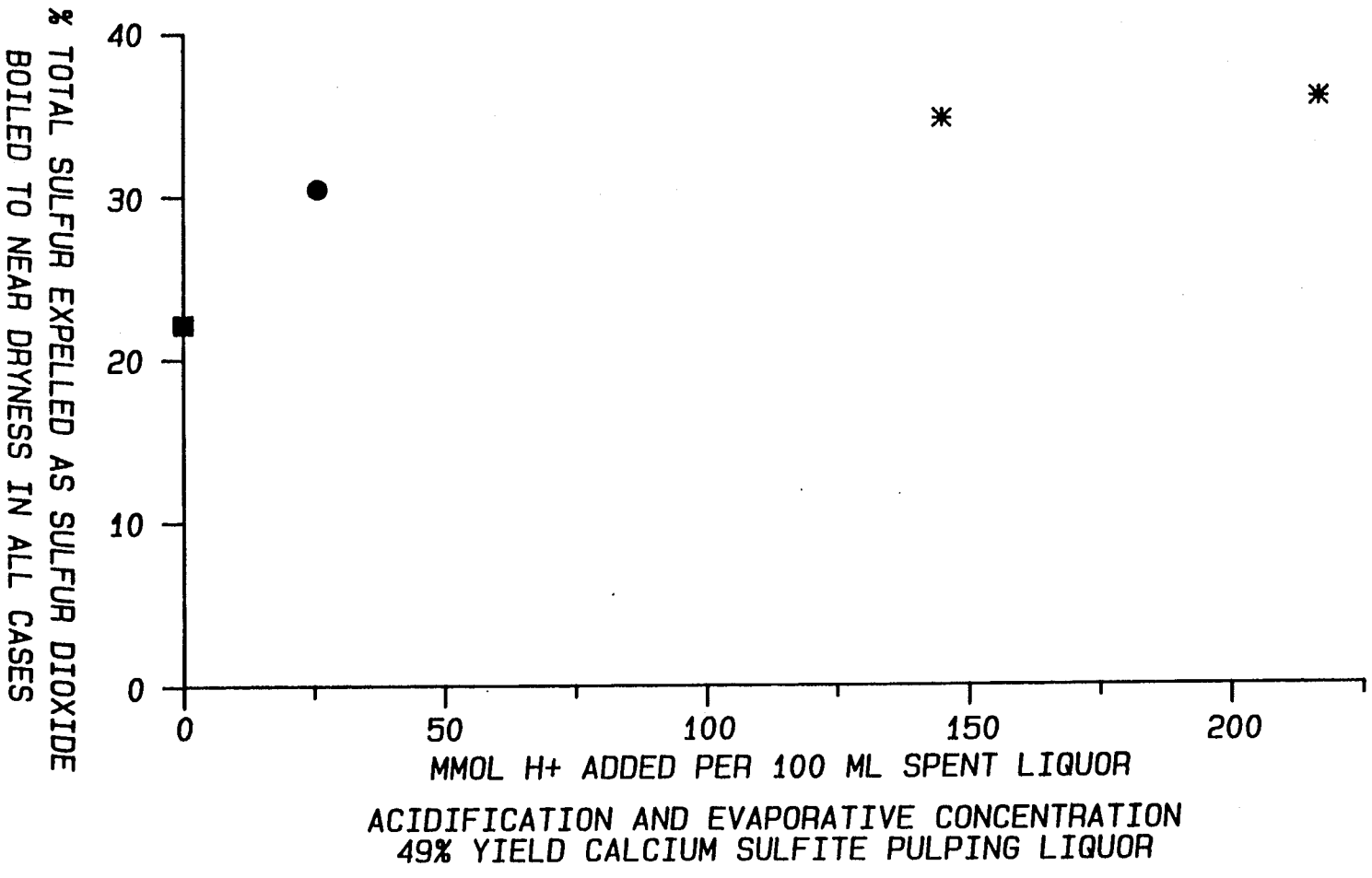
FIG. 9 is a graph that summarizes the chemical recovery results of acidification and evaporative concentration on a fourth specific spent liquor.

As a fourth example of how much sulfur dioxide can be expelled by this treatment process, FIG. 9 summarizes the amount of sulfur which can be removed from a 49% yield calcium-based pulping system as a function of hydrogen ion addition. In this test, the acid addition varied from zero to 0.25 mmol hydrogen ion per mg total sulfur in the untreated spent liquor. As was observed with example II, the other calcium sulfite chemical liquor, greater acid additions are required to reach the maximum sulfur dioxide expulsion. At a constant acid addition rate of 24 mmol hydrogen ion per 100 ml spent liquor, further evaporation is also required to maximize the sulfur dioxide expulsion. Evaporation to 50% by weight releases 19% of the sulfur dioxide available; evaporation to near dryness increases that amount to 35%.

FIG. 10 compares the sulfur species present in the untreated liquor and in the liquor after acidification with 24 mmol hydrogen ion per 100 ml spent liquor and 50% concentration. As in the other examples, the sulfur dioxide production is accompanied by a corresponding decrease in sulfone concentration.

We claim:

1. In a method for recycling sulfur dioxide from spent chemical and semi-chemical sulfite pulping liquor, the steps consisting of:
   a. acidifying the spent liquor;
   b. then evaporating the acidified spent liquor to expel sulfur dioxide and water vapor and;
   c. collecting the expelled sulfur dioxide and water vapor for recycling as pulping liquor.

2. In a method for recycling sulfur dioxide from spent chemical and semichemical sulfite pulping liquor, the steps consisting of:
   a. acidifying the spent liquor by adding a minimum of 0.024 mmol hydrogen ion per mg total sulfur content of the untreated spent liquor to a maximum of 0.75 mmol hydrogen ion per mg total sulfur content of the untreated spent liquor;
   then evaporating the acidified spent liquor at or near the boiling point of the spent liquor to a minimum of 5% moisture by weight of the spent liquor;
   c. collecting the sulfur dioxide and water vapor expelled from the acidified and evaporated spent liquor for recycling as pulping liquor.

3. In a method for recycling sulfur dioxide from spent chemical and semichemical sulfite pulping liquor the steps consisting of:
   a. acidifying the spent liquor by adding a minimum of 0.024 mmol hydrogen ion per mg total sulfur content of the untreated spent liquor to a maximum of 0.75 mmol hydrogen ion per mg total sulfur content of the untreated spent liquor;
   b. then evaporating the acidified spent liquor at or near the boiling point of the spent liquor to a minimum of 5% moisture by weight, to a maximum of 50% moisture by weight of the spent liquor;
   c. collecting the sulfur dioxide and water vapor expelled from the acidifed and evaporated spent liquor for recycling as pulping liquor.

* * * * *